United States Patent [19]

Brown

[11] 4,381,157

[45] Apr. 26, 1983

[54] RUG CLEANER

[75] Inventor: Robert S. Brown, Spartanburg, S.C.

[73] Assignee: Milliken Research Corporation, Spartanburg, S.C.

[21] Appl. No.: 956,028

[22] Filed: Oct. 30, 1978

[51] Int. Cl.[3] ..... B05C 17/02; A47L 11/32

[52] U.S. Cl. ..... 401/21; 401/37; 401/39; 401/140; 401/208; 401/220

[58] Field of Search ..... 401/16, 18, 21, 37–39, 401/138, 140, 195, 208, 218, 219, 220, 24, 25, 26, 27, 136, 139, 36, 17; 222/191, 613, 614

[56] References Cited

U.S. PATENT DOCUMENTS

| | | | |
|---|---|---|---|
| 632,891 | 9/1899 | Burnett | 401/220 |
| 1,059,427 | 4/1913 | Barnwell | 401/27 X |
| 2,935,754 | 5/1960 | Abdo et al. | 401/195 X |
| 2,976,112 | 3/1961 | Yonkers et al. | 401/21 X |
| 3,104,413 | 9/1963 | Nelson | 401/208 X |
| 3,127,631 | 4/1964 | Hershberger et al. | 401/140 |
| 3,173,165 | 3/1965 | Speight | 401/21 |
| 3,207,379 | 9/1965 | Waldrum | 222/614 |
| 3,289,240 | 12/1966 | Vanderveer et al. | 401/21 |
| 3,820,905 | 6/1974 | Sims | 401/140 |
| 4,097,953 | 7/1978 | McKinney et al. | 15/320 |

FOREIGN PATENT DOCUMENTS

| | | | |
|---|---|---|---|
| 2718205 | 11/1978 | Fed. Rep. of Germany | 401/18 |
| 6616625 | 5/1967 | Netherlands | 401/39 |

*Primary Examiner*—Steven A. Bratlie

*Attorney, Agent, or Firm*—Earle R. Marden; H. William Petry

[57] ABSTRACT

Lightweight, simple rug cleaner for residential use which uses a powdered cleaning composition for the cleaning of carpets. The cleaning composition comes in a throw-away, disposable container which is inserted into the rug cleaner for use.

3 Claims, 4 Drawing Figures

RUG CLEANER

Many consider wall-to-wall carpeting to be the peak of luxury; housewives love it for the warm atmosphere it brings, businessmen value it for the air of corporate dignity it lends their offices; but to those who must clean and maintain it, wall-to-wall carpeting is an immense headache. It must be cleaned in place, the cleaning must be accomplished in a relatively short time and if the carpet is not kept scrupulously clean, its life may be severly shortened. For these reasons, the carpet cleaning industry is constantly seeking improved methods and machinery for cleaning carpets.

Recently, a radically new approach to cleaning carpets has been developed which uses a powdered cleaning composition containing a mixture of extremely porous solid particles and a solvent. This new cleaning composition is described in U.S. Pat. No. 4,013,594 and has proved especially effective in removing soil from carpets. Further, only a short interval is required between application and removal of the powdered cleaning composition. Using this new cleaning composition, it has now become possible to clean wall-to-wall carpets in offices, stores and residences with little disruption of normal affairs.

It is therefore an object of the invention to provide a lightweight, low cost carpet cleaner which uses a powdered cleaning composition to clean carpets in place.

Other objects and advantages of the invention will become readily apparent as the specification proceeds to describe the invention with reference to the accompanying drawings in which.

Figure 1:
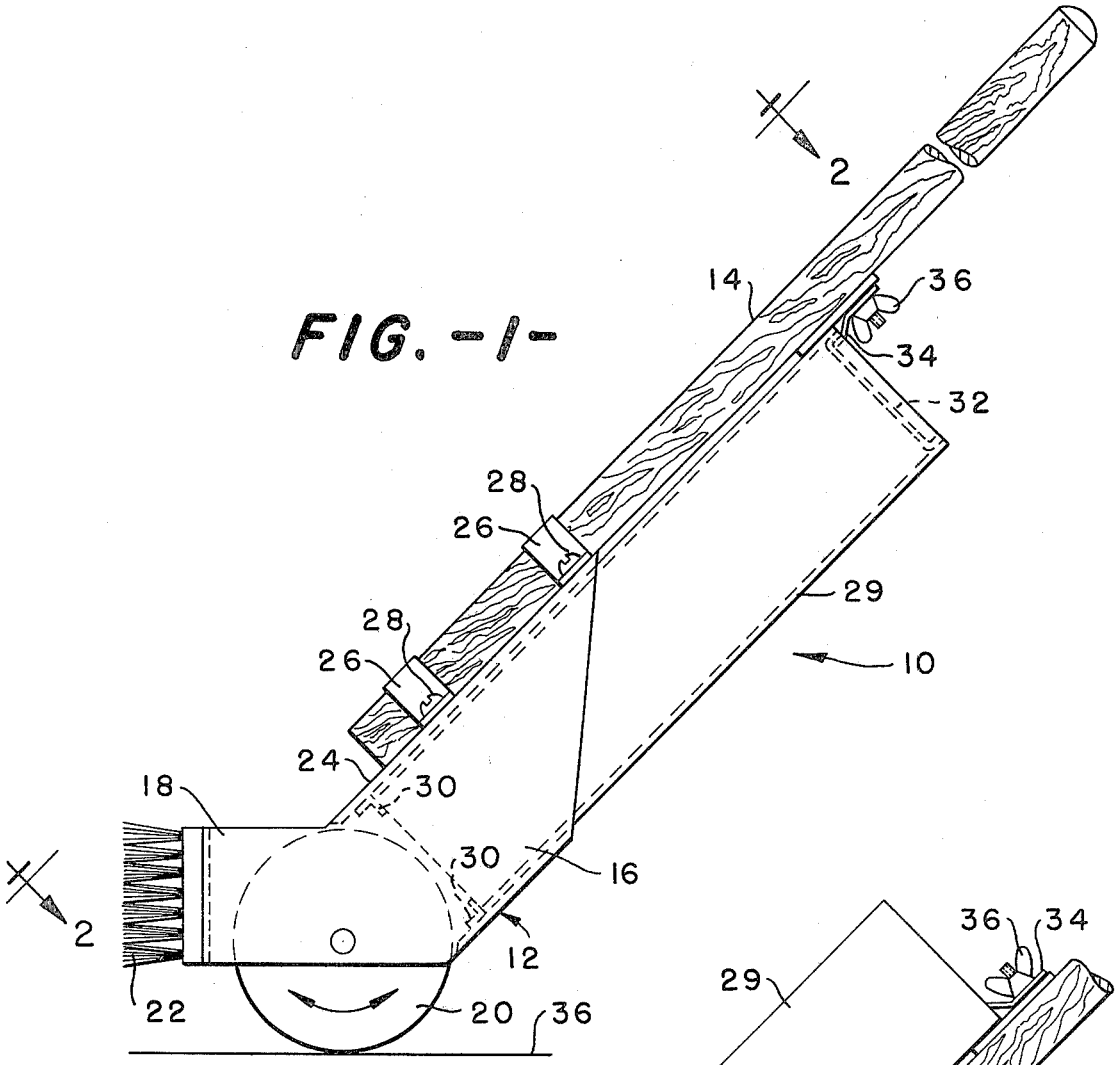
FIG. 1 is an end view of the new carpet cleaner in the powder distribution position.
Figure 2:
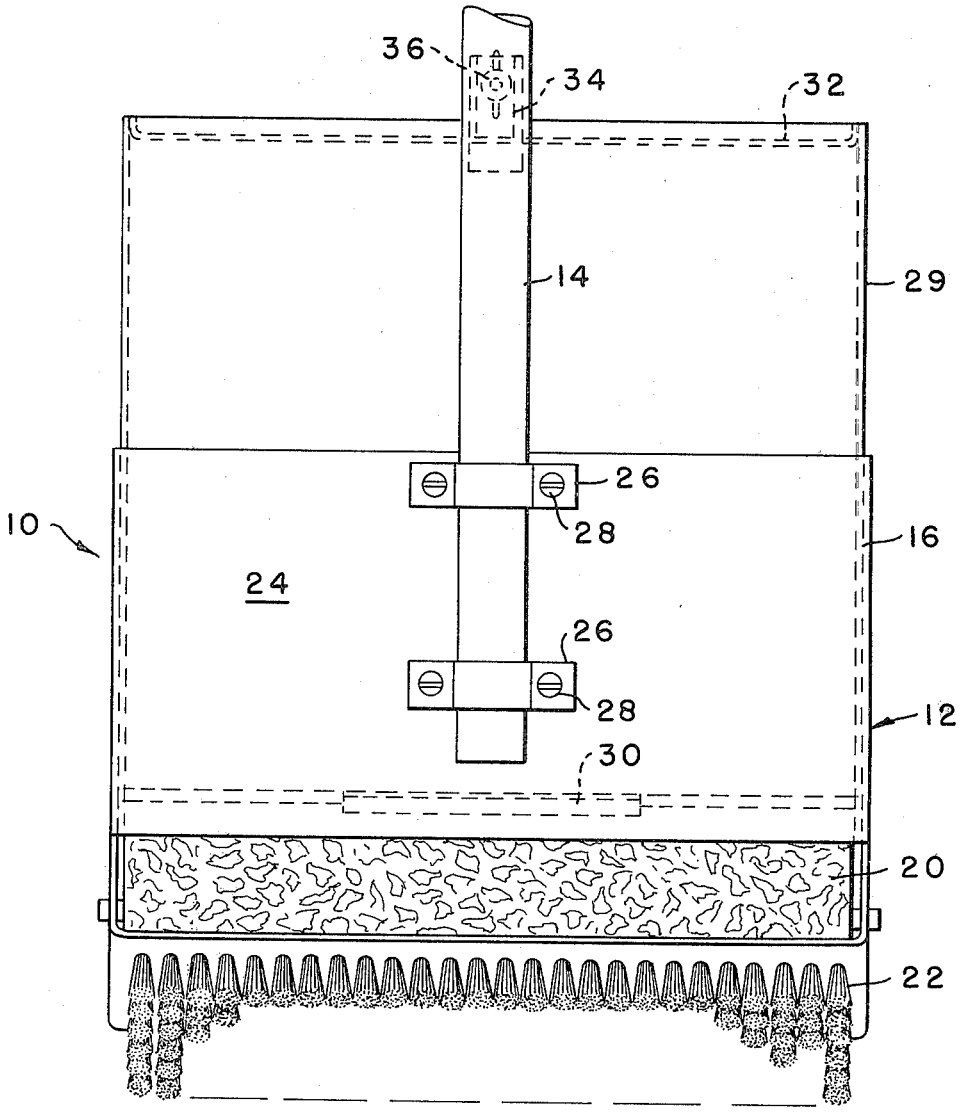
FIG. 2 is a view taken on line 2—2 of FIG. 1.

Looking now to FIGS. 1 and 2, the reference numeral 10 represents generally the new and improved carpet cleaner. The carpet cleaner 10 consists basically of a container-support member 12 and a handle 14. The container-support member 12 consists of a hollow powder support portion 16 and a cleaning section 18 at an angle to the powder support portion 16. The cleaning section 18 has a cylinder with a rough or porous surface, such as a reticulated foam cylinder 20 rotably mounted thereon in communication with the hollow powder support portion 16 and a brush 22 mounted on the end thereof for reasons hereinafter explained. The handle 14 is secured to the back 24 of the hollow powder support portion 16 by a pair of U-shaped flanged brackets 26 by screws 28.

Figure 3:
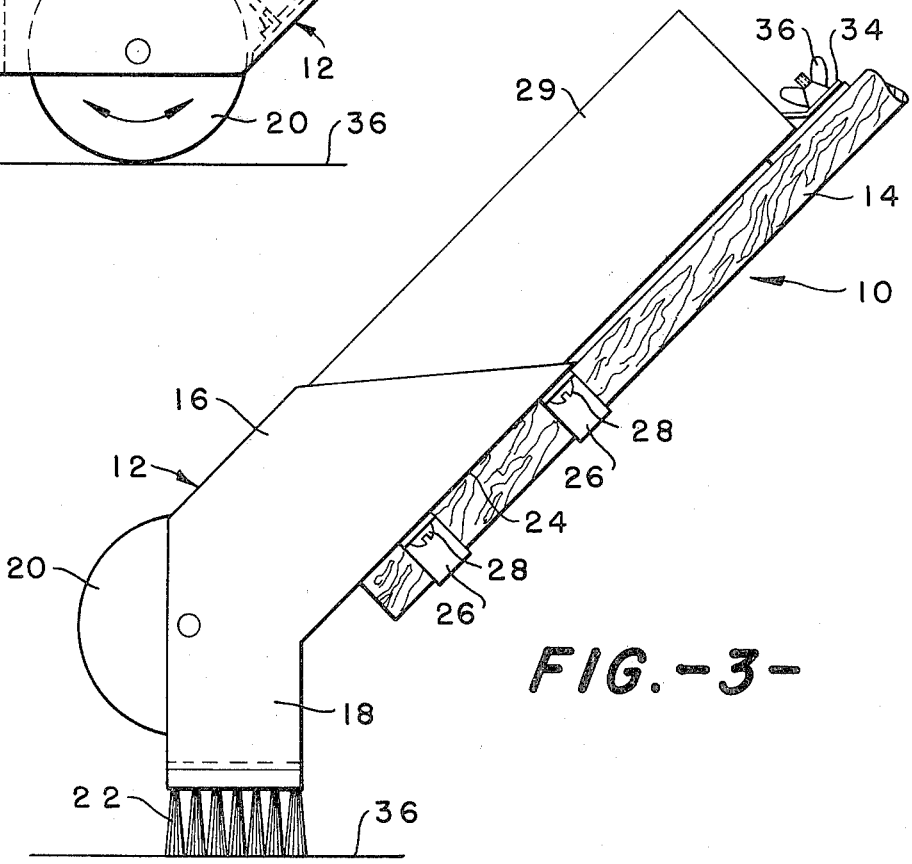
FIG. 3 is an end view of the new carpet cleaner in the cleaning position.

The powder dispenser 29 is preferably a throw-away container, which is opened at one end and slid downward until it engages the flanges 30 at the bottom of the hollow powder support portion 16 adjacent the foam cylinder 20. In FIGS. 1–3, the bottom 32 of the powder dispenser 29 is flanged and is engaged by a clip 34 which is secured to the handle 14 by wing nut 36. In the form of the invention shown in FIG. 4, the flanged bottom 32 is eliminated and integral elastic cord or wire member 38 is used to wrap around and/or slide over the handle 14.

OPERATION

Figure 4:
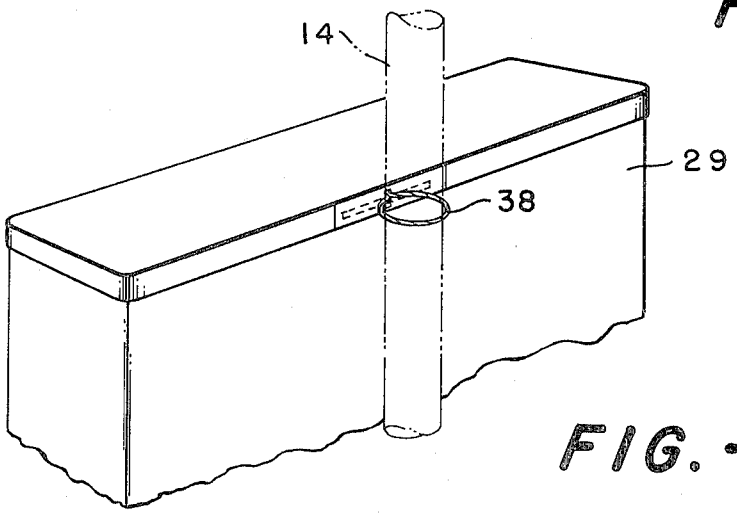
FIG. 4 is a modification of the carpet powder container and its mounting in the carpet cleaner.

When the carpet cleaner 10 is to be used, the powder container 29 is opened at the lower end and placed in the hollow powder section 16 and secured to the handle 14, as in FIGS. 3 or 4. The cleaner 10 is then placed on the carpet or surface 36 to be cleaned and guided over the surface 36 by the handle 14. As the cleaner 10 is moved over the surface, the cylinder 20 rotates to deposit cleaning powder from the container 29 onto the surface 36. When the surface 36 has been covered with powder, the cleaner 10 is turned over and the brush 22 is placed into contact with the surface 36, as in FIG. 3. The powder is rubbed onto the surface 36 to loosen the dirt therein which, along with powder, is swept up afterwards by a vacuum cleaner.

As described above, it can readily be seen that an improved carpet cleaner has been provided which is simple in construction, inexpensive to manufacture and easy to use, especially by a housewife.

Although the preferred embodiments of the invention have been described in detail, it is contemplated that many changes may be made without departing from the scope or spirit of the invention, and I desire to be limited only by the claims.

I claim:

1. A device for applying a substantially dry cleaning powder on a surface to be cleaned, such as a carpet comprising: a hollow container having a first section and a second section at an angle to said first section, a cylindrical powder transfer element rotatably mounted in said hollow container, said first section having a wall member which is substantially perpendicular to the surface to be cleaned when such surface is contacted by said cylindrical powder transfer element, a brush member mounted on said wall member having the bristles thereof substantially perpendicular thereto, means mounting a disposable powder container in said second section in communication with said cylindrical powder transfer element to supply cleaning powder thereto and a handle means connected to the outside of said hollow container to aid in moving said hollow container over the surface to be cleaned.

2. The device of claim 1 wherein said cylindrical powder transfer element is a cylinder with a rough or porous surface.

3. The device of claim 1 wherein the surface of said cylindrical powder transfer element is a reticulated foam.

* * * * *